US006575173B2

(12) United States Patent
Quan et al.

(10) Patent No.: US 6,575,173 B2
(45) Date of Patent: Jun. 10, 2003

(54) ULTRASONIC DEVICE FOR THE TREATMENT OF HAIR AND OTHER FIBERS

(75) Inventors: Ke Ming Quan, West Chester, OH (US); Fred Hamlin Murrell, Jr., Greenhills, OH (US); Theodore Jay Verbrugge, Reily, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/945,227

(22) Filed: Aug. 31, 2001

(65) Prior Publication Data

US 2003/0062056 A1 Apr. 3, 2003

(51) Int. Cl.[7] ..... A45D 24/00
(52) U.S. Cl. ..... 132/119.1; 132/148
(58) Field of Search ..... 132/148, 118, 132/119.1, 271; 607/79, 103, 109, 110; 601/2

(56) References Cited

U.S. PATENT DOCUMENTS

| | | | | |
|---|---|---|---|---|
| 3,211,159 A | | 10/1965 | Goble | |
| 3,254,424 A | | 6/1966 | Goble | |
| 3,281,948 A | | 11/1966 | Goble | |
| 4,023,579 A | * | 5/1977 | Suroff | 132/271 |
| 5,297,512 A | * | 3/1994 | Sharp | 132/119.1 |
| 5,875,789 A | | 3/1999 | Shigihara | |
| 6,145,513 A | | 11/2000 | Chu et al. | |
| 6,196,236 B1 | | 3/2001 | Imai et al. | |
| 6,203,320 B1 | * | 3/2001 | Williams et al. | 132/308 |
| 2002/0096125 A1 | * | 7/2002 | Fong | 119/664 |

FOREIGN PATENT DOCUMENTS

| | | |
|---|---|---|
| JP | 03-182203 | 8/1991 |
| JP | 08 001105 A | 1/1996 |
| JP | 97262120 A | 10/1997 |
| JP | 97308516 | 12/1997 |
| JP | 2001 120335 A | 5/2001 |

* cited by examiner

*Primary Examiner*—Todd E. Manahan
(74) *Attorney, Agent, or Firm*—Peter D. Meyer

(57) ABSTRACT

The invention is an ultrasonic device for the treatment of hair and other fibers. The device includes an ultrasound generator, a comb device responsive to the generated ultrasonic waves and a plurality of protuberances, having a natural bending frequency, extending outward from the comb device. Alternatively, the treatment device includes an ultrasound generator, a comb device responsive to the generated ultrasonic waves and a reflector for reflecting the incident ultrasonic waves disposed on the distal end of the comb device.

20 Claims, 3 Drawing Sheets

ULTRASONIC DEVICE FOR THE TREATMENT OF HAIR AND OTHER FIBERS

FIELD OF THE INVENTION

The invention is in the field of ultrasonic devices for the treatment of hair and other fibers.

BACKGROUND OF THE INVENTION

Devices that utilize ultrasonic mechanical vibrations are well known in the art. The treatment of natural and synthetic fibers to produce, alter, or remove a set has been the subject of prior work. For example, chemical agents are sometimes used, with or without heat, to produce a set in a fiber or for the removal of an existing fiber set. However, these methods are slow, laborious, ineffective, not topically efficacious, and the chemical agents used can ultimately damage the fibers being treated.

Ultrasonic mechanical vibrations are generally produced by Piezoelectric devices. Piezoelectric devices, which convert electrical impulses into mechanical vibrations, are generally based on the fact that certain crystals, when deformed by pressure, yield a mechanical motion. Resonant crystals and ceramics are used to generate such mechanical waves in solids and liquids. For high frequency, ultra-sonic vibrations to be generated, crystals operate in their thickness mode (the crystal becomes alternatingly thicker and thinner as it vibrates.)

Imai, U.S. Pat. No. 6,196,236, discloses a hair curling applicator that utilizes the longitudinal modes of vibration. Imai requires a user to manually wind hair around a hollow barrel. The hollow barrel oscillates longitudinally causing the wrapped hair to absorb ultrasonic energy in a shear (transverse) mode. Wrapping hair around the barrel is not convenient, especially if the hair has an applied treatment on it. Additionally, the user must wrap different portions of the treatment area sequentially, resulting in an inefficient use of time. Finally, safety is a concern, as the end of the vibrating barrel is not prevented from touching tissue. Such contact can cause sonic, deep tissue burns.

Shiginori, Japanese Publication JP 9-262120, teaches a hair drying, bleaching, and weaving device that also requires winding hair around a vibrating body. The presence of protruding vibrating bodies allows for an increase in treatment area, however, this teaching also requires wrapping hair around the vibrating body. Additionally, the protruding vibrating bodies do not provide uniform vibration as the protrusions at the end farthest from the generator deflect more than those closer to the generator. This limits the number of protrusions in order to maintain uniform motion. Finally, safety is problematic as the end of the vibrating body is not protected thus, the user could experience ultrasonic tissue burning.

Shigihara, U.S. Pat. No. 5,875,789 discloses a device for the permanent curling of hair. The user winds hair along a rod portion, where presumably longitudinal vibrations impart energy to the hair through frictional forces causing curling to occur. Again, wrapping hair around a rod portion is not convenient, especially if the hair has an applied treatment on it. Additionally, the user must wrap different portions sequentially, resulting in an inefficient time usage. Again, safety is a concern, as the end of the barrel is not prevented from touching tissue.

Goble, U.S. Pat. No. 3,211,159 discloses a hair treatment device that uses radial modes of vibration. This teaching does not require the wrapping of hair in order to provide treatment, however, multiple treatments are required in order to treat a large volume of hair. Additionally, safety is a large concern as a transducer that uses radial vibration modes can contact tissue and cause damage along the entire length of the transducer, and not just from the end as would happen from a transducer using longitudinal modes of vibration.

Therefore, it would be an improvement in the art to be able to provide a novel device that provides a treatment for a fiber, particularly hair, using a less reactive chemical agent, yet still provide a faster, less labor intensive, and more topically efficacious treatment experience.

SUMMARY OF THE INVENTION

In a non-limiting exemplary embodiment of the present invention, the fiber treatment device comprises an ultrasound generator capable of converting electrical energy to a mechanical vibration having a topically efficacious frequency, and a comb device responsive to the topically efficacious frequency coupled to the ultrasound generator. A reflector with a reflectance, R, is disposed on the distal end of the comb device and has a reflectance, R, expressed as $|R|>0$.

In yet another alternative embodiment of the present invention, the fiber treatment device comprises an ultrasound generator capable of converting electrical energy to a mechanical vibration having a topically efficacious frequency, and a comb device responsive to the topically efficacious vibrations acoustically coupled to the ultrasound generator. A plurality of protuberances, each of which has a natural bending frequency, and has a proximal end and a distal end, extend outwardly from the comb device.

BRIEF DESCRIPTION OF THE DRAWINGS

While the specification concludes with claims which particularly point out and distinctly claim the present invention, it is believed that the present invention will be better understood from the following description of preferred embodiments, taken in conjunction with the accompanying drawings, and wherein:

DETAILED DESCRIPTION OF THE INVENTION

The present invention is related to an ultrasonic device for the treatment of fibers, such as hair. The purpose for utilization of ultrasonic energy is not limited to, but includes, providing a more efficient manner in which to treat a fiber with a chemical agent. Increased efficiency in this manner reduces the amount of active chemical agent necessary, and can also reduce the required concentration of active chemical agent required to provide a topically efficacious result. Additionally, required treatment time can be reduced, thereby providing a time saving way to provide long-term fiber care at a reduced cost.

Figure 1:
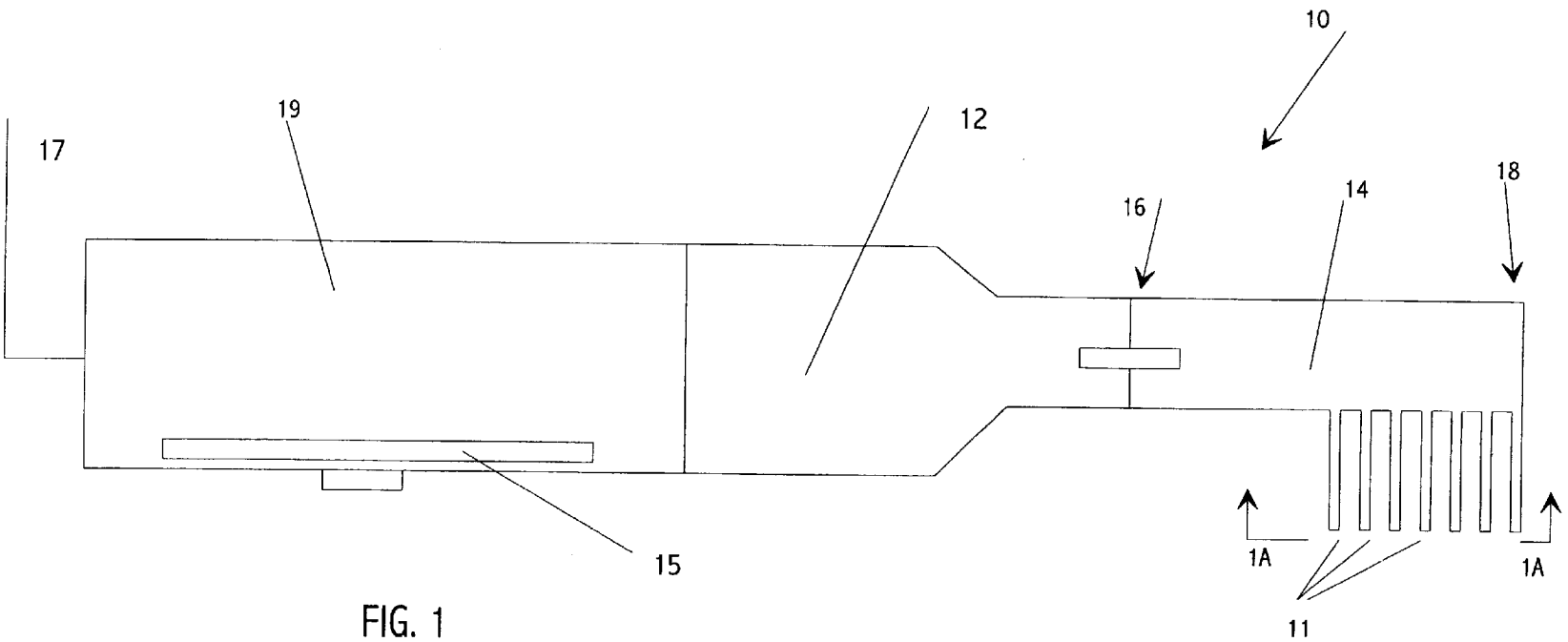
FIG. 1 is a plan view of a preferred embodiment of a fiber treatment device in accordance with the present invention.
Figure 1A:
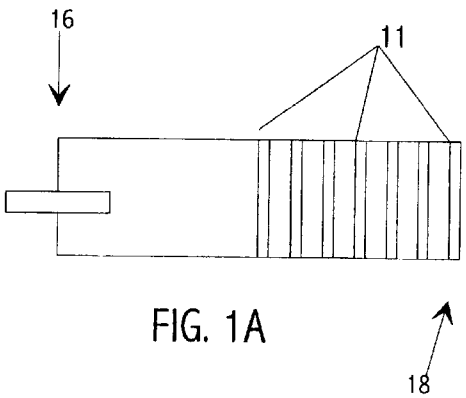
FIG. 1A is a fragmentary elevational view of the comb device of FIG. 1 taken along the line 1A—1A.

FIG. 1 illustrates a fiber treatment device in accordance with the present invention and is labeled generally by the numeral 10. The fiber treatment device 10 includes an ultrasound generator 12 and a comb device 14 with proximal end 16 and distal end 18. Without attempting to be limiting, distal end 18 of the comb device 14 has a plurality of protuberances 11 that extend outwardly in a coplanar geometry, from the longitudinal axis of comb device 14. Each protuberance has a natural bending frequency of the i mode in Hertz, $f_i$, defined by the equation:

$$f_i = \frac{\lambda_i^2}{2\pi L^2}\left(\frac{EI_o}{\mu A_o}\right)$$

where, E=Modulus of Elasticity of the protuberance, $I_o$=Moment of inertia of the widest point along the protuberance, L=Length of the protuberance, $A_o=b_o \times h_o$ where $h_o$ is the height of the beam at the supported end in the plane of vibration and $b_o$ is the width of the beam at the support, $\mu$=Material density, and, $\lambda_i$=function of boundary conditions and taper.

Exemplary and non-limiting material property data for materials suitable for comb device 14 and for boundary conditions and taper, $\lambda_i$, are tabulated below and can also be found in *Elements of Material Science*, Van Vlack, $4^{th}$ ed., and *Mechanics of Materials*, Beer and Johnson, both of which are herein incorporated by reference.

| Material | Density - ρ - ($g/cm^3$) | Modulus - E - (MPa) |
|---|---|---|
| Aluminum Alloy | 2.7 | 70,000 |
| Stainless Steel | 7.93 | 205,000 |
| Titanium | 4.43 | 113,000 |

The comb device 14 is responsive to mechanical vibrations developed by the ultrasound generator 12. Exemplary and non limiting frequencies providing topically efficacious treatments and developed by ultrasound generator 12 preferably range from 15 KHz to 500 KHz, more preferably from 18 KHz to 300 KHz, and most preferably from 20 KHz to 150 KHz.

Ultrasound generator 12 is capable of converting an applied electrical power into a mechanical vibration. As non-limiting examples, the electrical power applied to ultrasound generator 12 can be supplied from a conventional wall outlet or from an internal, or external, rechargeable, or disposable, battery contained within fiber treatment device 10. The applied power is then converted by power supply 19 to the desired oscillatory frequency and voltage level. In a preferred embodiment, the converted power is then applied across piezoelectric ceramic plates to generate a pressure wave or a mechanical wave at the desired oscillatory frequency.

Thus, comb device 14 provides an effective and efficient mechanical impedance matching device for transmitting the generated ultrasonic vibrations from ultrasound generator 12 through proximal end 16 to distal end 18 and preferably to protuberances 11 disposed on comb device 14. Without wishing to be bound by theory, it is believed that the proper and most efficient oscillatory frequency is determined by the mass of comb device 14. Thus, the working dimensions of comb device 14 and protuberances 11 should be selected so that the vibrations produced by ultrasound generator 12 are in resonance with comb device 14 and adapted to be efficiently transmitted from ultrasound generator 12 through comb device 14 to protuberances 11.

It is preferred that the effect of protuberances 11 on the overall system be minimized. It was found that this could be accomplished by providing protuberances 11 with a natural bending frequency significantly lower or higher than the operating frequency of the fiber treatment device 10. It was surprisingly found that if the natural bending frequency of protuberances 11 is near the longitudinal frequency of comb device 14, the protuberances 11 act as dynamic stiffeners, thereby raising the natural frequency of the comb device 14. Whereas, if the bending natural frequency of the protuberances 11 is much lower than the longitudinal natural frequency of comb device 14, there is only a small component of mass added to comb device 14 and its effect on the overall natural frequency is minimal. Again, without wishing to be bound by theory, it is believed that providing protuberances 11 with significantly lower or higher natural bending frequencies than comb device 14 will minimize the effect on the system natural frequency due to changes in the natural bending frequency of protuberances 11 during contact with fibers, such as hair, and/or fiber treatment products.

Finite Element Analysis (FEA) is an exemplary method for determining the dynamic behavior of protuberances 11. For example, using FEA, it was surprisingly found that a comb device 14 design comprising alternating long and short parallelpiped protuberances 11 facilitated the conveyance of mechanical energy along the active areas of adjacent protuberances. Additionally, mechanical energy was conveyed along the entire depth of each protuberance 11 when the protuberance's natural bending frequency is much lower than the longitudinal natural frequency of the shaft of comb device 14.

If protuberances 11 are designed to provide non-resonance with ultrasound generator 12, additional benefits can be found. For example, the comb device 14 can be designed with a longer shaft length. This provides a benefit of allowing for more protuberances 11 in efficacious regions of comb device 14 than would be otherwise possible, allowing for a larger treatment region. This also allows, as an additional benefit, the ability of protuberances 11 having any dimensions or geometry. Non-limiting, but exemplary, protuberance geometries include straight, tapered, variable cross section, mushroom-shaped, and protuberances of different lengths, different widths, different heights, different shapes, geometries, spacing, and combinations thereof. Additionally, protuberances 11 can taper, converge, or diverge inwardly, outwardly, or be chamfered, rounded, and combinations thereof. It is preferred that protuberances 11 have a variable height, cross-section, and spacing. It is also preferred that protuberances have a generally uniformly tapered shape in relation to the longitudinal axis of comb device 14.

Power for ultrasound generator 12 can be provided by either conventional commercial methods and converted to a necessary voltage by power supply 15. Alternatively, batteries contained within fiber treatment device 10 can provide power for ultrasound generator 12. Internal batteries could enable fiber treatment device 10 to be placed within a recharging receptacle while not in use as would be known to one of skill in the art. Power supplied by power supply 15 or internal batteries could also be used to heat the fiber treatment device 10 if a fiber treatment regimen so requires thermal energy to provide a more efficacious fiber treatment.

Figure 2:
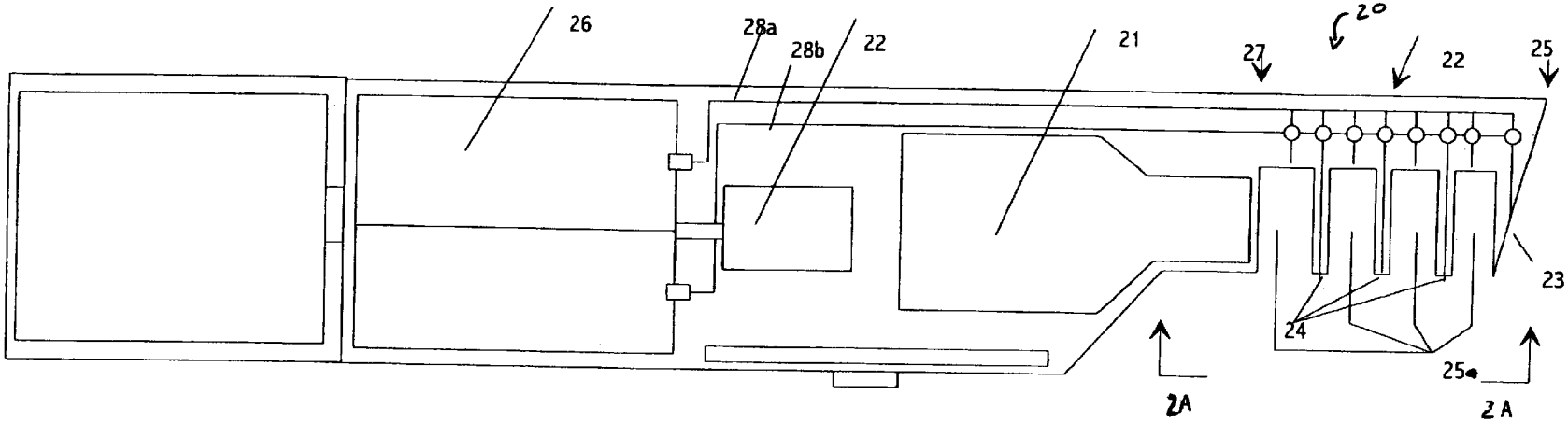
FIG. 2 is a plan view of an alternative embodiment of a fiber treatment device showing an acoustically insulated comb device and reflector.
Figure 2A:
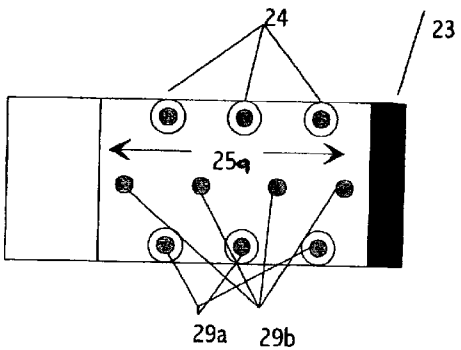
FIG. 2A is a fragmentary elevational view of the comb device of FIG. 2 taken along the line 2A—2A.

FIG. 2 depicts another embodiment of a fiber treatment device 20. Fiber treatment device 20 generally comprises an ultrasound generator 21 and comb device, generally labeled as 22. Comb device 22 preferably has a proximal end 27 and a distal end 25, and generally comprises a device for converging fibers into a region proximate to ultrasound generator 21. A reflector 23 is attached to the distal end 25 of comb device 22. Comb device 22 is preferably physically coupled to ultrasound generator 21. However, as would be known to one of skill in the art, it is possible to provide ultrasound generator 21 and comb device 22 as separate components without any physical attachment. However, if physical coupling or attachment is desired, it can be accomplished by providing an insulator material between comb device 22 and the ultrasound generator 21. Alternatively, physical attachment can be accomplished by attaching comb device 22 to an insulative housing encasing ultrasound generator 21.

Preferably, comb device 22 is acoustically insulated from ultrasound generator 21. Acoustic insulation or acoustically insulated as used in the present invention means that comb device 22 is not acoustically resonant with ultrasound generator 21. This means that comb device 22 remains stationary while ultrasound generator 21 is active.

Physical coupling and acoustic insulation can be accomplished by the choice of construction and the method of physical attachment of comb device 22 to ultrasound generator 21. Because comb device 22 is preferably not acoustically coupled to ultrasound generator 21, the materials selected to manufacture comb device 22 should preferably be insulative in nature, such as plastic or wood. However, it would be known to one of skill in the art that the comb device 22 can be manufactured from metal and provide no acoustic coupling, for example, by providing an acoustic insulator between ultrasound generator 21 and comb device 22. Additionally, polymeric materials can be impregnated with a metal, or metals, to provide an acoustically insulated comb device 22 that provides an efficacious, ultra-sonic, fiber treatment. A metal impregnated polymer can provide a more resilient structural device, yet still provide the physical acoustic insulative ability required.

Comb device 22 also comprises a reflector 23 designed to have a reflectance, R, expressed as:

$$R = \frac{Z_2 - Z_1}{Z_2 + Z_1}$$

where, $Z_1$=the acoustic impedance of wet fiber, and, $Z_2$=the acoustic impedance of the reflector. $Z_1$ and $Z_2$ are defined by the equations:

$$Z_2=\rho_2 c_2$$

and, $$Z_1=\rho_1 c_1$$

where, $\rho_1$=the density of wet fiber, $\rho_2$=the density of the reflector, $c_1$=the acoustic velocity in wet fiber, and, $c_2$=the acoustic velocity in the reflector. Acoustic velocity is the speed at which a pressure wave propagates in the selected medium. Values for the acoustic velocity and density of exemplary fibers and other materials are tabulated below. However, the values of acoustic velocity and density for numerous other fibers and materials can be found in *The Handbook of Chemistry and Physics,* 78$^{th}$ edition, *Fundamental Physics of Ultrasound*, by V. A Shutilov, *Chemical and Physical Behavior of Human Hair,* 3d ed., by Clarence R. Robbins, and *IEEE Transactions on Sonics and Ultrasonics*, Vol. SU-32, No. 3 (1985), pages 381–394, all of which are herein incorporated by reference.

| Material | Density - ρ - (g/cm$^3$) | Velocity - c - (m/s) |
|---|---|---|
| Air | $1.161 \times 10^{-3}$ | 334 |
| Water | 0.998 | 1490 |
| Aluminum Alloy | 2.7 | 6260 |
| Human Hair Fiber | 1.3 | 1717 |
| Nylon Fiber | 1.12 | 2600 |

Reflector 23 is preferably attached to the distal end 25 of comb device 22 to form an open cavity 25 between reflector 23 and ultrasound generator 21. It is preferred that the materials selected to construct the reflector 23 provide an overall reflectance, R, so that:

$$|R|>0,$$

and more preferably the materials selected to construct the reflector 23 provide an overall reflectance, R, so that:

$$|R|\geqq 0.5.$$

Therefore, the inner surface, that is, the surface of reflector 23 closest to ultrasound generator 21, should be constructed of a material that effectively reflects acoustic waves generated by ultrasound generator 21. Exemplary and non-limiting reflective materials include metals and porous materials, such as wood. Most preferably, reflector 23 is constructed to have a thin metal sheet, film, or foil that has a region of air behind and positioned away from ultrasound generator 21 so that an acoustic vibration originating from ultrasound generator 21 will be significantly reflected in an opposite direction from the incident wave. This is generally known in the art as an air-backed reflector. Without desiring to be bound by theory, it is believed that such a reflector is effective because air generally has significant contrasting acoustic impedance in contrast with any liquid or solid material.

It is known in the art that the acoustic impedance of air (the product of air density and air acoustic velocity) is negligible given that the acoustic velocity in air is approximately 310 m/s and the density of air is almost 0 kg/m$^3$. Contrastingly however, the acoustic impedance of water is very high. Since the density of water is 1000 kg/m$^3$ and the velocity of sound in water is approximately 1500 m/s, the acoustic impedance of water is approximately $1.55\times10^6$ kg/m$^2$s. Calculation of the reflection coefficient using the formula provided supra, shows a near total reflection of an acoustic vibration at the water/air interface showing that a water/air interface is a nearly perfect reflector. Additional calculations can be made by one skilled in the art to show that an air-backed reflector comprised of Aluminum sheet material and an air jacket disposed therebetween also forms a nearly perfect acoustic reflector. Here, the reflector (air) is provided with a defined surface due to the presence of the metal substrate. This well-defined surface is then able to accurately reflect an incident wave arriving normal to the surface.

In a preferred embodiment, the distal end 25 of comb device 22 is also provided with a plurality of protuberances 24 to increase the coupling of fibers located between ultrasound generator 21 and reflector 23. Preferably, protuberances 24 are not affected by ultrasound generator 21 and form no part of the overall ultrasonic mathematical equation provided supra.

Special considerations should be given to the choice of the cavity 25 size incorporated into comb device 22, for instance, depth, width and length, so that within the cavity 25, the ultrasonic field is uniform to provide even fiber treatment. Outside the cavity 25, the ultrasonic field intensity decays rapidly and should minimally impact fibers outside the defined periphery of comb device 22. This makes an ultrasonic treatment safe for fibers and other unintended objects, especially hair dyeing, even in the hair root region where the skin on the scalp is in the vicinity of the operative fiber treatment device 20. Additionally, the optimum size of the cavity 25 depends on the applied ultrasonic frequency, f. For example, the optimum length, L, of the cavity 25 can be expressed by the equation:

$$L=kf$$

where k is a linear coefficient determined by the slope of the line comparing optimal comb length, L, to applied frequency, f. Preferably, exemplary and non-limiting values for k have been found to range from 0.009 cm/KHz to 0.020 cm/KHz. Most preferably the value for k is 0.013 cm/KHz.

As shown in FIG. 2, fiber treatment device 20 preferably includes a number of reservoirs 26, shown as cartridges. One advantage of a multiple reservoir dispensing system is that materials that would be incompatible for storage together may be stored in separate reservoirs and then dispensed together for use. Because the materials are mixed at the point of use as needed, there is better control over the amount of product mixed, resulting in minimal or no wasted product.

Any suitable reservoir 26 may be utilized in the present invention. It should be understood that the reservoir utilized may be fully or partially internal to the fiber treatment device 20, or fully or partially external to the fiber treatment device 20, and may or may not be removable from the fiber treatment device 20. Additionally, the reservoir 26 utilized may be permanent or disposable to the fiber treatment device 20. Non-limiting examples of suitable reservoirs 26 include positive displacement type reservoirs, such as a cartridge, and pump-evacuated type reservoirs, such as sachets, bladders, blisters, and combinations thereof. It is also believed that pre-loaded cartridge reservoirs could be used as single use disposable cartridges, multiple use disposable cartridges, or refillable cartridges, and that empty cartridges may be available for loading with suitable materials by the end user.

In the practice of the present invention, the reservoir 26 may be adapted for dispensing equal or different amounts of material. In any regard, it is preferred that the dispensing system be utilized for the delivery of precise, controlled, or efficacious amounts of treatment materials. It is also preferred that one or more of the reservoirs 26 of the present invention be loaded with a fiber treatment material in a sequential fashion. However, as it would be known to one of skill in the art, that sequential dispensing may also be accomplished by sequentially dispensing from different reservoirs 26 or combinations of reservoirs 26. Further, it should also be understood that a number of repeatable sequences could also be dispensed from either one cartridge or a combination of cartridges.

Reservoirs 26 are placed within the reservoir holder with one or more of the reservoirs 26 in liquid communication with the comb device 22. Dispensing actuator 27 is adapted to dispense material from cartridge 26 through dispensing passageways 28*a*, 28*b* to comb device 22. A plurality of dispensing apertures 29*a*, 29*b* are fluidly connected to dispensing passageways 28*a*, 28*b* and release material to the fiber being treated either from an aperture 29*b* disposed on comb device 22 or from an aperture 29*a* located on protuberance 24. Thus, incompatible chemistries, or chemistries that, after mixing, have a finite shelf life are mixed and/or dispensed at the point of application directly to the fibers. Further, the chemistries are further mixed at the point of application by the presence of the mechanical, ultrasonic vibrations produced by ultrasound generator 21.

Figure 3:
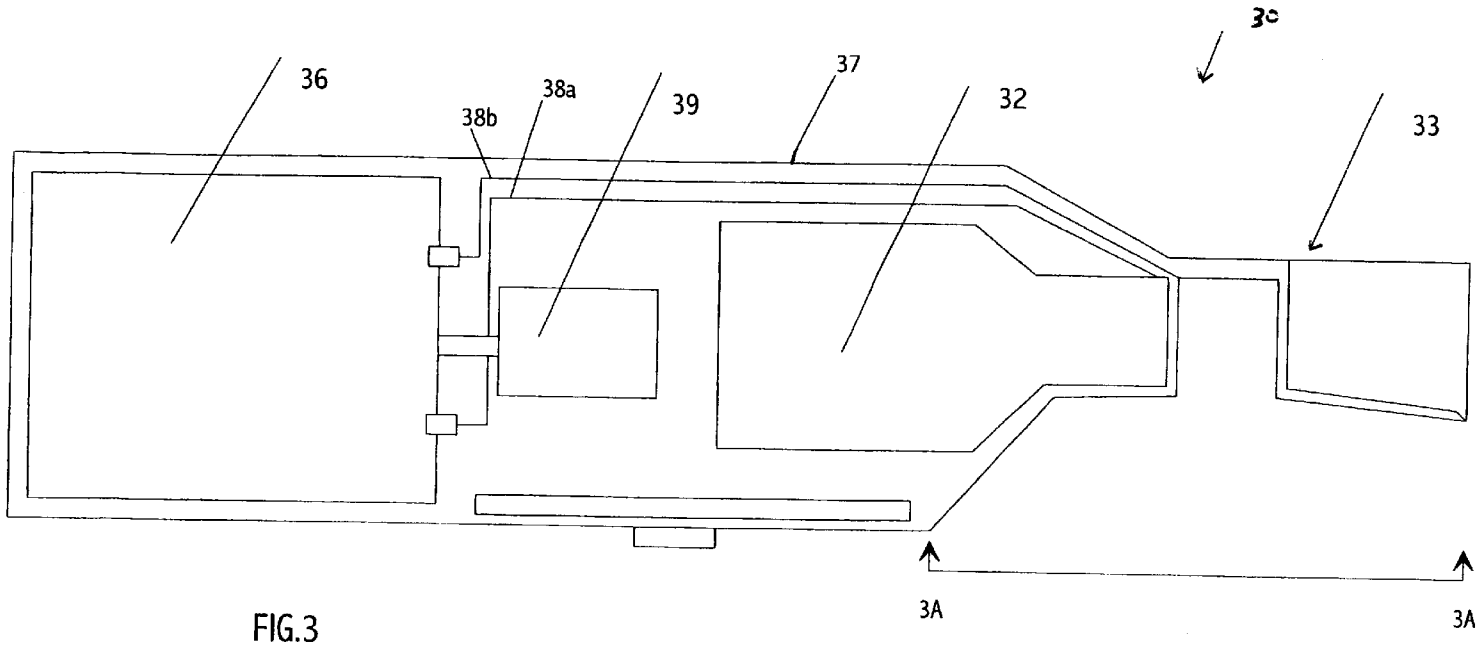
FIG. 3 is a plan view of an alternative embodiment of a fiber treatment device showing a funnel device; and, FIG. 3A is a fragmentary elevational view of the comb device of FIG. 3 taken along the line 3A—3A.
Figure 3A:
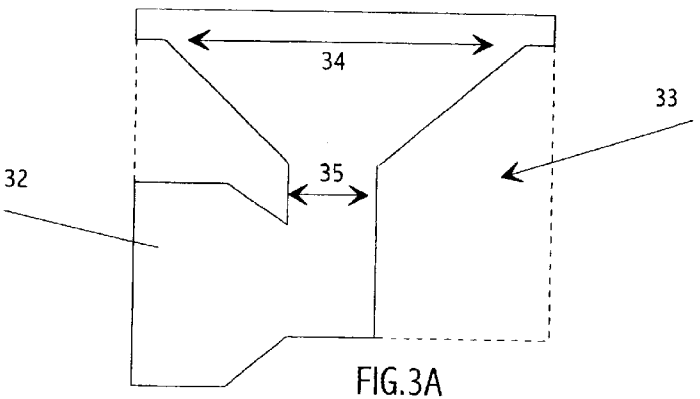

FIG. 3 depicts another variation of a fiber treatment device in accordance with the present invention is. Fiber treatment device 30 includes an ultrasound generator 32 and funnel-like device 33. As shown in FIGS. 3 and 3A, funnel device 33 is generally planar and has a large open region 34 that collects fibers from a substantially large region, and a small open region 35 proximate to the ultrasound generator 32. Funnel device 33 comprises a transition from large open region 34 to small open region 35 that effectively reduces the cross-sectional area of the fibers collected by large open region 34 so that all collected fibers are brought into the region of small open region 35 and placed proximate to ultrasound generator 32. Preferably, the collected fibers are then efficaciously treated by material dispensed by reservoirs 36 contained within the body portion 37 of fiber treatment device 30 and dispensed into small open region 34 through dispensing passageways 38*a*, 38*b* by dispensing actuator 39. However, it would be known to one of skill in the art that reservoirs 36 can be external to body portion 37 of fiber treatment device 30. Ultrasound generator 32 treats the collected fibers in small open region 35 by the production of mechanical vibrations of a topically efficacious frequency as discussed supra. Without wishing to be bound by any theory, it is believed that the compaction of the collected fibers into small open region 35 improves the acoustic coupling between ultrasound generator 32 and small open region 35.

It is preferred that funnel device 33 be physically coupled, yet remain acoustically insulated from ultrasound generator 32. Therefore, it is preferred that the materials selected to manufacture funnel device 33 preferably be insulative in nature. However, it would be known to one of skill in the art that the funnel device 33 can be manufactured from metal and provide no acoustic coupling, for example, by providing an acoustic insulator between ultrasound generator 32 and funnel device 33. Additionally, polymeric materials can be impregnated with a metal, or metals, to provide an acoustically insulated funnel device 33 that provides an efficacious, ultrasonic fiber treatment. A metal impregnated polymer can provide a more resilient structural device, yet still provide the physical acoustic insulative ability required.

A method of use for a fiber treatment device commensurate with the scope of the present invention provides for the treatment of fibers, particularly hair. First, it is preferred that a user pre-wets the hair fibers to be ultrasonically treated. Non-limiting examples for pre-wetting hair include rinsing with water and/or cleaning the hair fibers with a cleaner, such as shampoo, or a cleaner/conditioner, such as PertPlus™, manufactured by The Procter & Gamble Company. Next, the treatment product, or active compound, to be applied to the hair fibers is applied in a topically efficacious amount to produce the results desired for the hair fiber being treated. Preferably, the treatment product is dispensed directly from the fiber treatment device when the fiber treatment device is equipped with reservoirs containing the treatment product. However, if the fiber treatment device is not so equipped, the treatment product can be manually applied to the hair fibers through conventional methodologies.

Finally, the operationally energized fiber treatment device is placed in contact with the treated hair fibers preferably using a steady and continuous motion from the root end of the hair fiber to the tip end of the hair fiber. Preferably, this motion is repeated until all desired hair fibers are efficaciously treated. It has been surprisingly found that approximately five minutes of treating hair fibers with a topically efficacious amount of colorant as an active compound using the ultrasonic fiber treatment device of the present invention is comparable to thirty minutes of treatment using conventional color uptake methods. Thus, the total time required to provide an efficacious treatment of a full head of hair can be reduced from 30–40 minutes using current treatment procedures to approximately 5–10 minutes total treatment time with use of the present invention. Of course, the total time required to provide such a topically efficacious treatment will depend upon the length and thickness of the hair fibers being treated and the desired resultant color intensity. However, it has been found that when coloring hair with a visible root line or when coloring patched gray hair, it may be preferable to apply the use of the ultrasonic fiber treatment device for longer time periods than would normally be required for hair fibers not exhibiting these characteristics.

It is also envisaged that the exemplary procedure described supra can also be used for the topically efficacious treatment of pet hair fibers. Additionally, it is intended that fabric and other fibers can be treated using the ultrasonic fiber treatment device and an active compound as discussed above.

The foregoing examples and descriptions of the preferred embodiments are not intended to be exhaustive or to limit the invention to the precise forms disclosed, and modifications and variations are possible and contemplated in light of the above teachings. While a number of preferred and alternate embodiments, systems, configurations, methods, and potential applications have been described, it should be understood that many variations and alternatives could be utilized without departing from the scope of the invention. Accordingly, it is intended that such modifications fall within the scope of the invention as defined by the claims appended hereto.

What we claim is:

1. A fiber treatment device comprising:

an ultrasound generator capable of converting electrical energy to a mechanical vibration having a topically efficacious frequency;

a comb device coupled to said ultrasound generator and having a proximal end and a distal end and responsive to said topically efficacious vibrations;

a reflector with a reflectance, R, disposed on said distal end of said comb device; and, wherein said reflectance is expressed as:

$$|R|>0;$$

$$\text{wherein} \quad R = \frac{Z_2 - Z_1}{Z_2 + Z_1};$$

wherein $Z_1$=acoustic impedance of wet fiber; and, $Z_2$=acoustic impedance of said reflector;

wherein $Z_2=\rho_2 c_2$; and, $Z_1=\rho_1 c_1$; and, wherein $\rho_1$=density of wet fiber;

$\rho_2$=the density of said reflector;

$c_1$=the acoustic velocity in wet fiber; and, $c_2$=the acoustic velocity in said reflector.

2. The fiber treatment device of claim 1 further comprising a fiber converging device coupled to said comb device wherein said fiber converging device converges said fiber into a region proximate to said ultrasound generator.

3. The fiber treatment device of claim 2 wherein said fiber converging device comprises a funnel shape.

4. The fiber treatment device of claim 1 wherein said reflectance is expressed as:

$$|R| \geqq 0.5.$$

5. The fiber treatment device of claim 1 wherein said topically efficacious frequency is from about 15 KHz to about 500 KHz.

6. The fiber treatment device of claim 5 wherein said topically efficacious frequency is from about 20 KHz to about 150 KHz.

7. The fiber treatment device of claim 1 further comprising:

a first material reservoir for supplying a first material; and, a second material reservoir for supplying a second material; and, wherein said first material reservoir and said second material reservoir are in liquid communication with said comb device.

8. The fiber treatment device of claim 7 wherein at least a portion of at least one of said first or second reservoirs are removeably contained within said fiber treatment device.

9. A fiber treatment device comprising:

an ultrasound generator capable of converting electrical energy to a mechanical vibration having a topically efficacious frequency;

a comb device acoustically coupled to said ultrasound generator wherein said comb device is responsive to said mechanical vibration; and, a plurality of protuberances having a proximal end and a distal end and extending outwardly from said comb device wherein each of said protuberances has a natural bending frequency defined by:

$$f_i = \frac{\lambda_i^2}{2\pi L^2}\left(\frac{EI_o}{\mu A_o}\right)$$

wherein:

E=Modulus of Elasticity of said protuberance $I_o$=Moment of inertia of the widest point along said protuberance L=Length of said protuberance $A_o=b_o \times h_o$ where $h_o$ is the height of the beam at the supported end in the plane of vibration and $b_o$ is the width of the beam at the support $\mu$=Material density $\lambda_i$=function(boundary conditions and taper).

10. The fiber treatment device of claim 9 wherein said topically efficacious frequency is from about 15 KHz to about 500 KHz.

11. The fiber treatment device of claim 10 wherein said topically efficacious frequency is from about 20 KHz to about 150 KHz.

12. The fiber treatment device of claim 9 further comprising:

a first material reservoir for supplying a first material; and, a second material reservoir for supplying a second material wherein said first and second reservoirs are in liquid communication with said comb device.

13. The fiber treatment device of claim 12 wherein at least a portion of at least one of said first material reservoir and said second reservoir are removeably contained within said body.

14. The fiber treatment device of claim 12 wherein said fiber treatment device efficaciously heats fibers treated thereby.

15. The fiber treatment device of claim 9 wherein said mechanical vibrations have a primary direction and wherein said comb device comprises an elongate cylinder having a longitudinal axis, a proximal end, and a distal end and wherein said longitudinal axis is parallel to, and in communication with, said primary direction of said mechanical vibrations.

16. The fiber treatment device of claim 15 wherein said proximal end and said distal end of said plurality of protuberances defines a longitudinal axis and wherein said longitudinal axis of said plurality of protuberances is transverse to said longitudinal axis of said elongate cylinder.

17. The fiber treatment device of claim 16 wherein said longitudinal axis of said plurality of protuberances is perpendicular to said longitudinal axis of said elongate cylinder.

18. The fiber treatment device of claim 9 wherein said protuberances have a variable cross section.

19. The fiber treatment device of claim 9 wherein said protuberances have a variable spacing from each other.

20. The fiber treatment device of claim 9 wherein said protuberances have a variable height.

* * * * *

UNITED STATES PATENT AND TRADEMARK OFFICE

CERTIFICATE OF CORRECTION

PATENT NO. : 6,575,173 B2 
DATED : June 10, 2003
INVENTOR(S) : Ke Ming Quan, Fred H. Murrell and Theo J. Verbrugee It is certified that error appears in the above-identified patent and that said Letters Patent is hereby corrected as shown below:

Title page,
Item [*] Notice, "0 days" should read -- 88 days --.

Signed and Sealed this

Sixteenth Day of September, 2003

JAMES E. ROGAN
*Director of the United States Patent and Trademark Office*